US011128081B2

(12) United States Patent
Yang et al.

(10) Patent No.: US 11,128,081 B2
(45) Date of Patent: Sep. 21, 2021

(54) EASILY ASSEMBLED CONNECTOR

(71) Applicants: KUNSHAN AMPHENOL ZHENGRI ELECTRONICS CO., LTD., Kunshan (CN); Amphenol LTW Technology Co., Ltd., New Taipei (TW)

(72) Inventors: Sheng-Ho Yang, New Taipei (TW); Hsu-Chuan Yen, New Taipei (TW); Xiao-Feng Fan, New Taipei (TW)

(73) Assignees: KUNSHAN AMPHENOL ZHENGRI ELECTRONICS CO., LTD., Kunshan (CN); AMPHENOL LTW TECHNOLOGY CO., LTD., New Taipei (TW)

( * ) Notice: Subject to any disclaimer, the term of this patent is extended or adjusted under 35 U.S.C. 154(b) by 72 days.

(21) Appl. No.: 16/655,197

(22) Filed: Oct. 16, 2019

(65) Prior Publication Data

US 2021/0057841 A1 Feb. 25, 2021

(30) Foreign Application Priority Data

Aug. 23, 2019 (CN) ..... 201910783325.4

(51) Int. Cl.
*H01R 13/424* (2006.01)
*H01R 24/28* (2011.01)
*H01R 107/00* (2006.01)

(52) U.S. Cl.
CPC ..... *H01R 13/424* (2013.01); *H01R 24/28* (2013.01); *H01R 2107/00* (2013.01)

(58) Field of Classification Search
CPC ... H01R 13/424; H01R 24/28; H01R 2107/00
See application file for complete search history.

(56) References Cited

U.S. PATENT DOCUMENTS 4,963,106 A * 10/1990 Wendling ..... H01R 13/4364 439/595
5,496,194 A * 3/1996 Huss, Jr. ..... H01R 13/4365 439/595

(Continued)

FOREIGN PATENT DOCUMENTS

EP 2076943 B1 11/2009
TW 201448381 A 12/2014

(Continued)

OTHER PUBLICATIONS

Search Report dated May 8, 2020 of the corresponding European patent application No. 19208142.0.

(Continued)

*Primary Examiner* — Edwin A. Leon
*Assistant Examiner* — Milagros Jeancharles
(74) *Attorney, Agent, or Firm* — Chun-Ming Shih; HDLS IPR Services

(57) ABSTRACT

An easily assembled connector includes an insulative base (10), a plastic core (20) and conductive terminals (30). The insulative base (10) has a chamber (12). The plastic core (20) is correspondingly received in the chamber (12) and has a guiding hole (21) and troughs (22) surrounding and communicating with the guiding hole (21). Each trough (22) is formed with a terminal hole (A). The conductive terminals (30) are separately correspondingly installed in the terminal holes (A).

8 Claims, 11 Drawing Sheets

(56) References Cited

U.S. PATENT DOCUMENTS

| | | | | |
|---|---|---|---|---|
| 7,101,192 | B1 * | 9/2006 | Bordeau | H01R 13/4364 439/66 |
| 7,351,117 | B1 | 4/2008 | Mostoller et al. | |
| 7,494,377 | B2 | 2/2009 | Yohn et al. | |
| 9,954,305 | B2 | 4/2018 | Yu et al. | |
| 10,340,631 | B1 * | 7/2019 | Hung | H01R 13/635 |
| 2003/0199205 | A1 * | 10/2003 | Kosmala | H01R 13/65912 439/752 |
| 2005/0250365 | A1 * | 11/2005 | Starke | H01R 13/622 439/320 |

FOREIGN PATENT DOCUMENTS

| | | | |
|---|---|---|---|
| TW | M581780 | U | 8/2019 |
| TW | M588910 | U | 1/2020 |

OTHER PUBLICATIONS

Office Action dated Feb. 27, 2020 of the corresponding Taiwan patent application No. 108130884.

* cited by examiner

EASILY ASSEMBLED CONNECTOR

BACKGROUND OF THE INVENTION

Technical Field

The invention relates to connectors, particularly to an easily assembled connector.

Related Art

Connectors are used to provide electric connection between different power wires. A connector includes an insulative base and conductive terminals inserted into the insulative base. A power wire includes core wires, each of which is connected to one of the terminals.

There are several manners of connection between a power wire and a connector. One is soldering the core wires with the conductive terminals first and then separately inserting the conductive terminals into the terminal holes of the insulative base. Another one is inserting the conductive terminals into the terminal holes of the insulative base first, and then connecting the core wires with the conductive terminals.

However, in the abovementioned manners, assembling of the conductive terminals and the insulative base is complicated, time-consuming and inconvenient because the insulative base is a one-piece body. The stability after assembling is not good enough. It is not economic. Also, connectors tend to be more and more compact, so gaps between the terminal holes are seriously shortened and assembling difficulty is further increased. Moreover, most components of such a connector are intended to be used once. This also causes waste of resources.

SUMMARY OF THE INVENTION

An object of the invention is to provide an easily assembled connector, which can simplify the assembling process and shorten the assembling time by separating the insulative base and the plastic core.

To accomplish the above object, the easily assembled connector of the invention includes an insulative base, a plastic core and conductive terminals. The insulative base has a chamber. The plastic core is correspondingly received in the chamber and has a guiding hole and troughs surrounding and communicating with the guiding hole. Each trough is formed with a terminal hole. The conductive terminals are separately correspondingly installed in the terminal holes.

The plastic core and the conductive terminals can be easily assembled into the insulative base by the slidable fit of the guiding pillar and the guiding hole. The engaging block can be engaged with the engaging hole when the plastic core arrives at a predetermined position. When pressing the handle stem of the flexible arm, the engaging block escapes from the engaging hole and both the plastic core and the conductive terminals can be easily taken out of the insulative base. All components can be not only taken out but also used repeatedly. By the embedding arrangement of the protrusion bar and the grooves, the conductive terminals can be accurately inserted into the terminal holes. By the separation of the insulative base and the plastic core, manufacturing and processing of all components become easier.

DETAILED DESCRIPTION OF THE INVENTION

Please refer to FIGS. 1-8. The invention provides an easily assembled connector including an insulative base 10, a plastic core 20 and conductive terminals 30.

Figure 4:
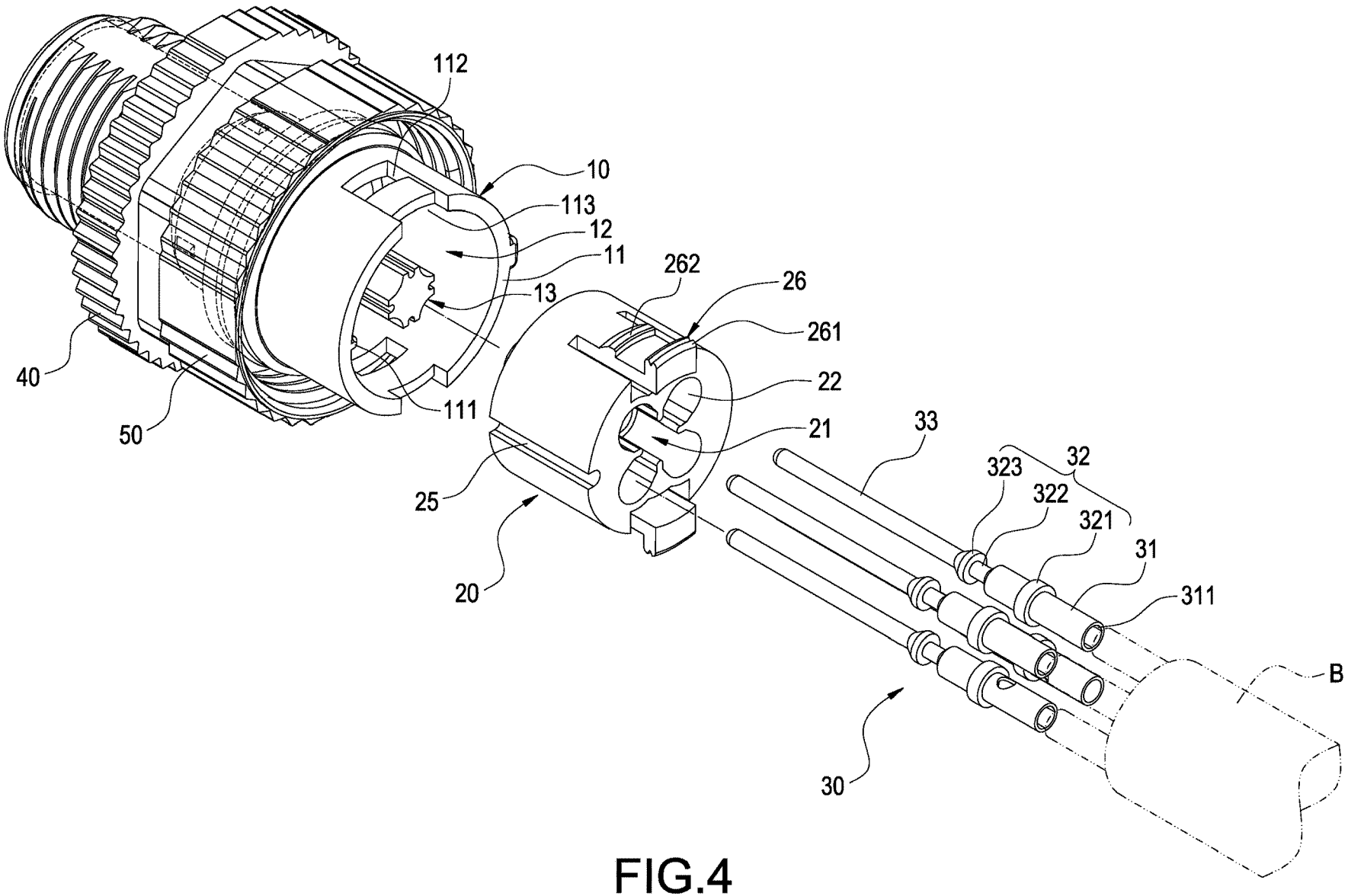
FIG. 4 is an exploded view of the easily assembled connector of the invention.
Figure 5:
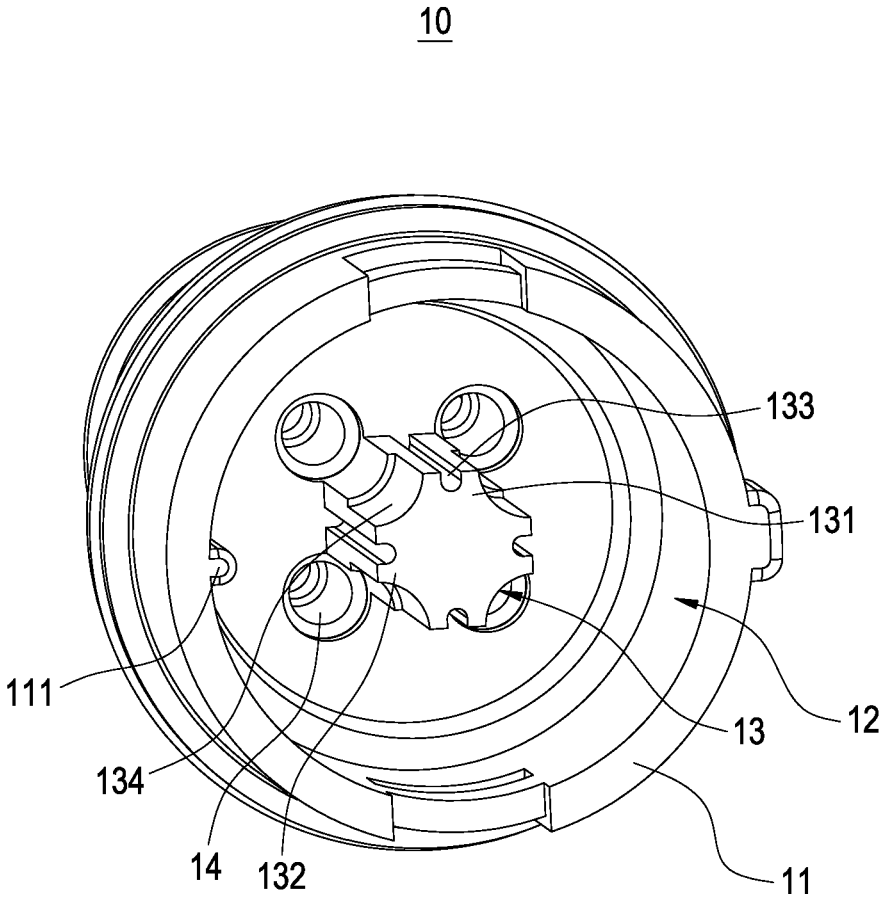
FIG. 5 is a perspective view of the insulative base of the invention.

Please refer to FIGS. 4-5 first. The insulative base 10 is made of plastic and is substantially of a cylindrical shape. A side of the insulative base 10 is formed with an annular wall 11. A chamber 12 is formed in the annular wall 11. The center of the chamber 12 is extended with a guiding pillar 13. A positioning rib 111 is formed on an inner side of the annular wall 11. Two corresponding positions of the annular wall 11 are provided with an engaging hole 112 and an engaging notch 113.

The guiding pillar 13 is substantially of a cross shape and includes a vertical rod 131 and a horizontal rod 132 across the vertical rod 131. Each end surface of both the vertical rod 131 and the horizontal rod 132 is formed with a groove 133. A concave curved surface 134 is formed between every two adjacent end surfaces of the vertical rod 131 and the horizontal rod 132. Each concave curved surface 134 has a step. A through hole 14 penetrating the insulative base 10 is provided at a root of each concave curved surface 134.

Figure 1:
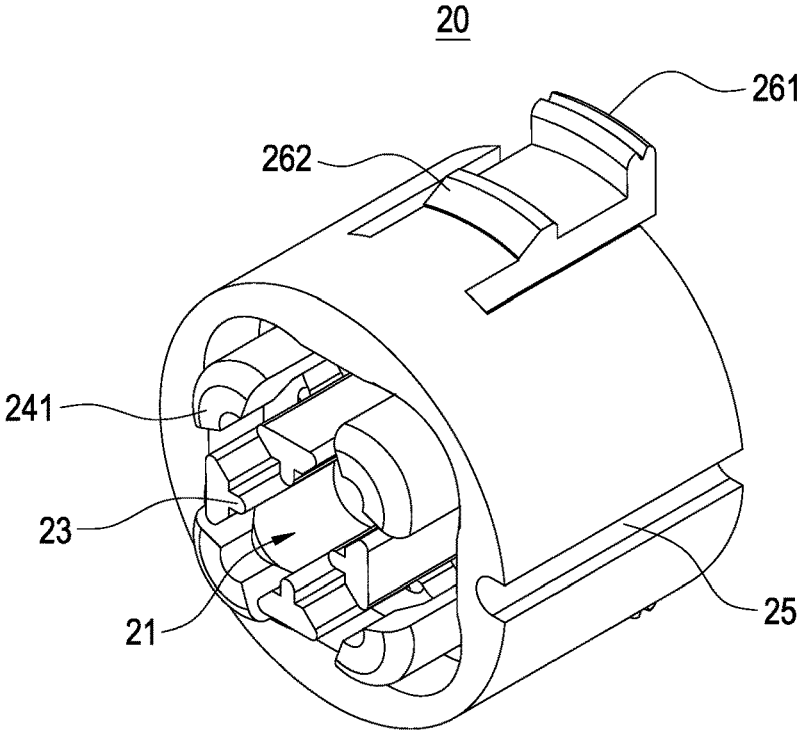
FIG. 1 is a perspective view of the plastic core of the invention.
Figure 2:
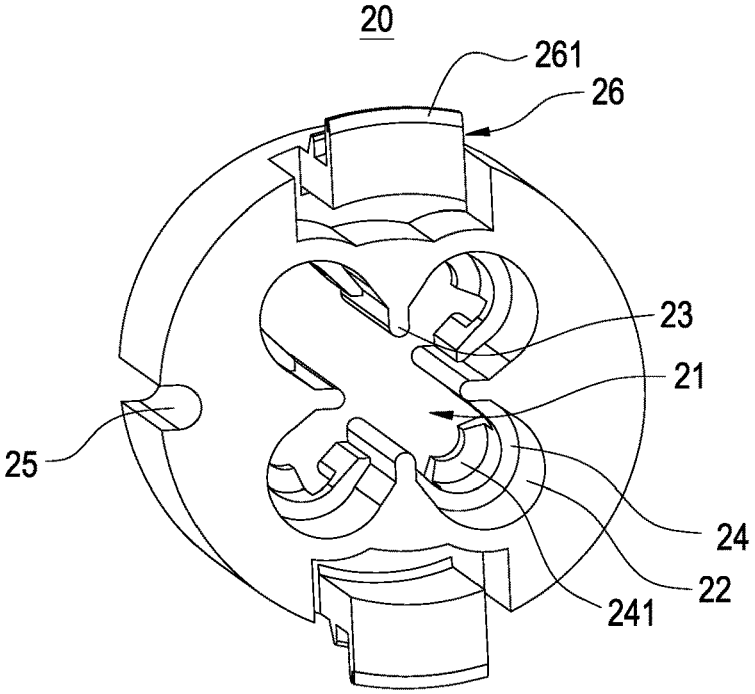
FIG. 2 is another perspective view of the plastic core of the invention.
Figure 3:
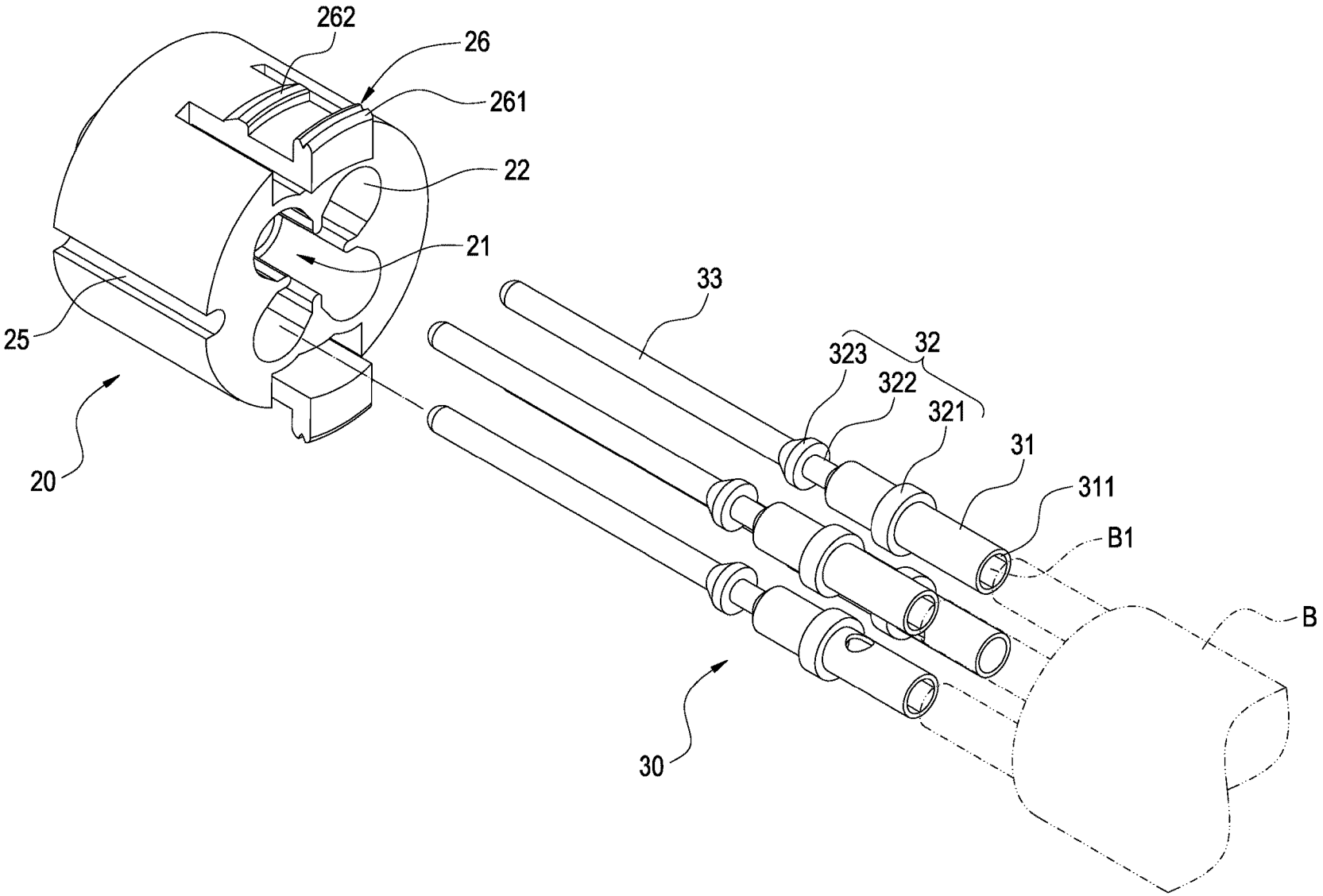
FIG. 3 is an exploded view of the plastic core and the conductive terminals of the invention.
Figure 7:
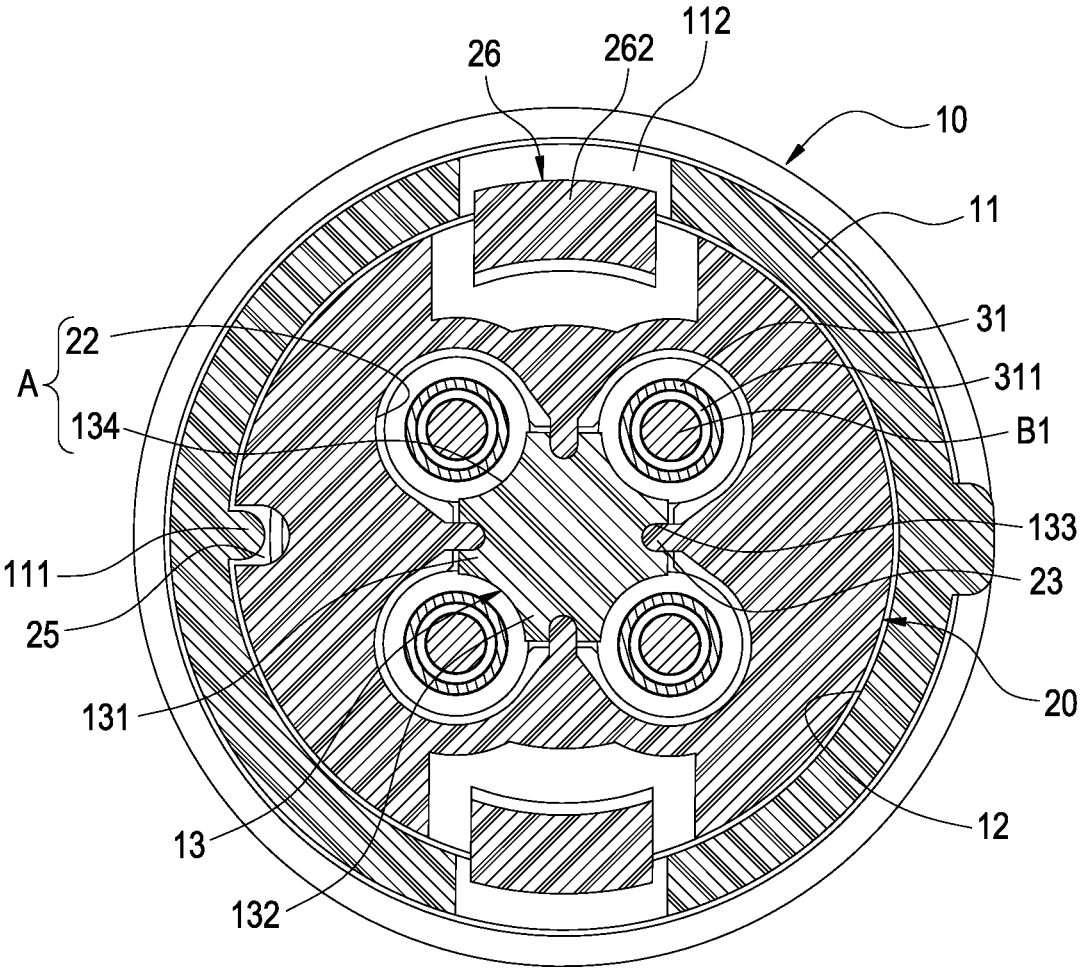
FIG. 7 is a cross-section view along line 7-7 in FIG. 6.

Please refer to FIGS. 1-3. The plastic core 20 is made of plastic and is a hollow cylinder installed in the chamber 12. The center of the plastic core 20 has a guiding hole 21. Troughs 22 are formed around the guiding hole 21 and communicate with the guiding hole 21. The guiding hole 21 is inserted by the guiding pillar 13. A terminal hole A is formed by each trough 22 and one of the concave curved surface 134 as shown in FIG. 7.

Figure 6:
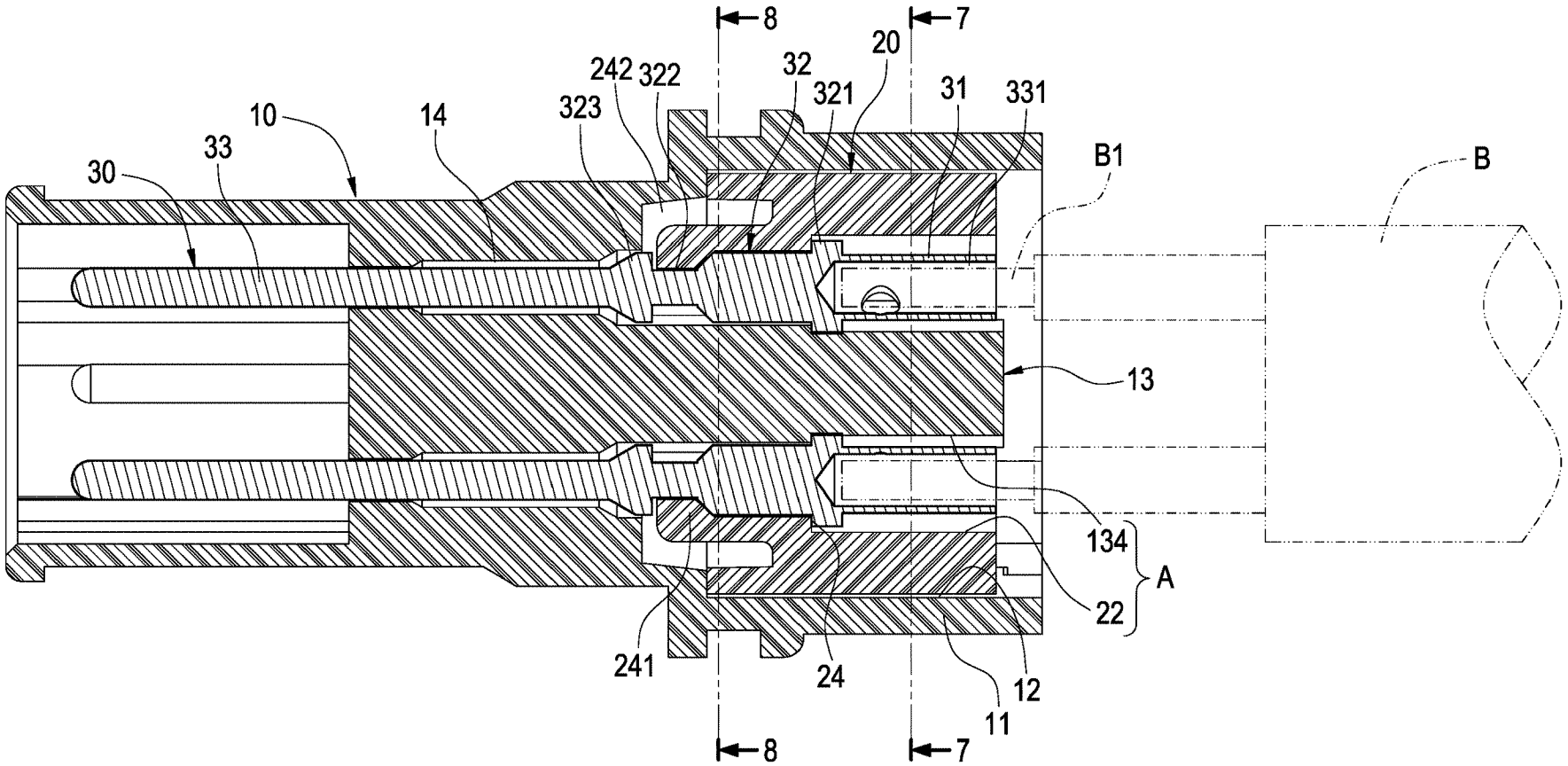
FIG. 6 is a cross-section view of the easily assembled connector of the invention.

Furthermore, a protrusion bar 23 is formed between every two adjacent troughs 22. Each protrusion bar 23 is embedded into one of the grooves 133. A blocking ring 24 is provided in each of the troughs 22. A bottom end of the blocking ring 24 is formed with an elastic hook 241. An escaping space 242 is formed between the back of the elastic hook 241 and the inner wall of the chamber 12 as shown in FIG. 6. An outer surface of the plastic core 20 is formed with a positioning channel 25 for being embedded by the positioning rib 111. Each of two corresponding positions of the front side of the plastic core 20 is provided with a flexible arm 26. An end of each flexible arm 26 is formed with a handle stem 261 being embedded into the engaging notch 113 for engagement. A middle of each flexible arm 26 is formed with an engaging block 262 being embedded into the engaging hole 112 for engagement.

Figure 8:
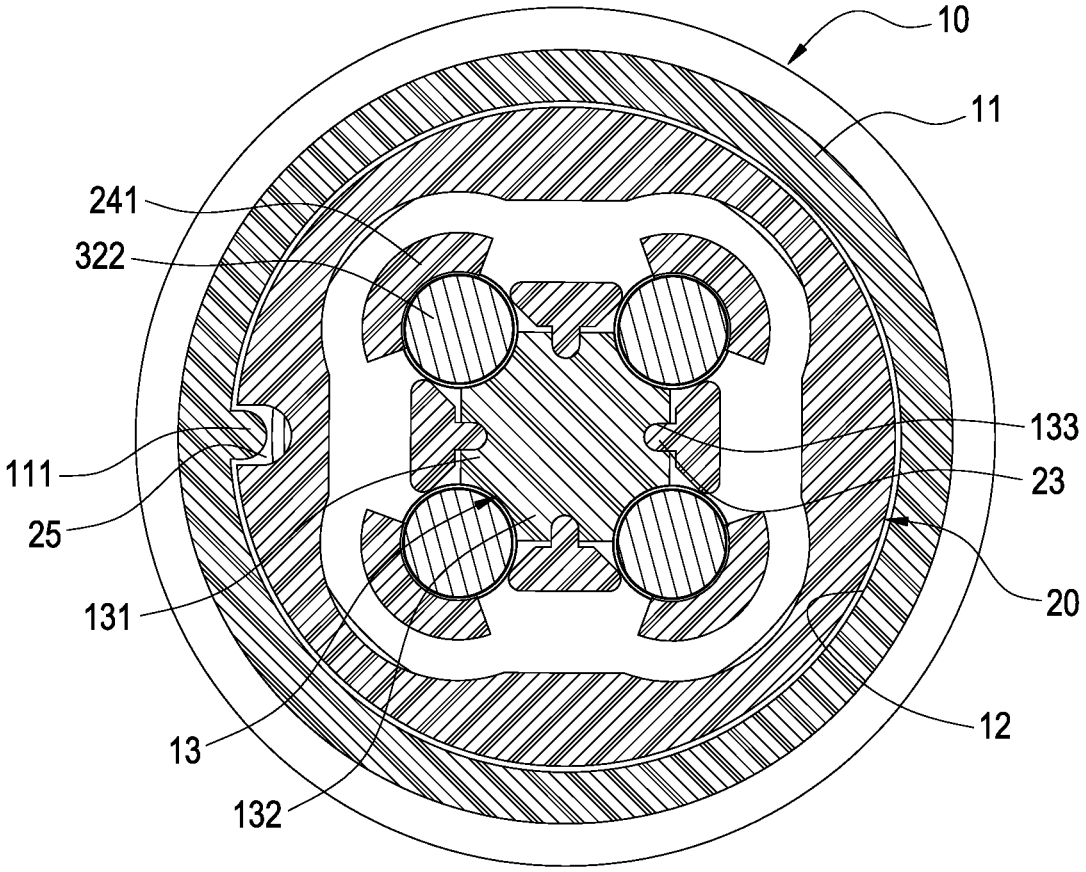
FIG. 8 is a cross-section view along line 8-8 in FIG. 6.

Please refer to FIGS. 4, 6 and 8. Each conductive terminal 30 is received in one of the terminal holes A. The embodiment uses male terminals as an example but female terminals are also available. Each conductive terminal 30 includes a connecting section 31, a fixing section 32 extending from the connecting section 31 and a guiding section 33 extending from the fixing section 32.

Further, each connecting section 31 has a wire hole 311 for being inserted by a core wire B1. Each fixing section 32 has a stopping ring 321, a neck portion 322 below the stopping ring 321 and a hook portion 323 below the neck portion 322.

When assembling, insert the guiding pillar 13 into the guiding hole 21 to form slidable connection first, and then insert each of the conductive terminals 30 into one of the terminal holes A. When the hook portion 323 reaches the elastic hook 241, the elastic hook 241 is pushed by the hook portion 323 to be aslant bent toward the escaping space 242 to make the conductive terminals 30 easily enter the terminal holes A. After the elastic hook 241 has passed the hook portion 323, the elastic hook 241 will directly restore to be embedded into and engage with the neck portion 322. Also, the stopping ring 321 is stopped by the blocking ring 24 and the elastic hook 241 is limited by the hook portion 323, so that the conductive terminals 30 can be prevented from being reversely pulled out of the terminal holes A.

The easily assembled connector of the invention further includes a sleeve 40 around a side of the insulative base 10 and a screwing element 50 connected to an end of the sleeve 40 and put around the insulative base 10.

Figure 9:
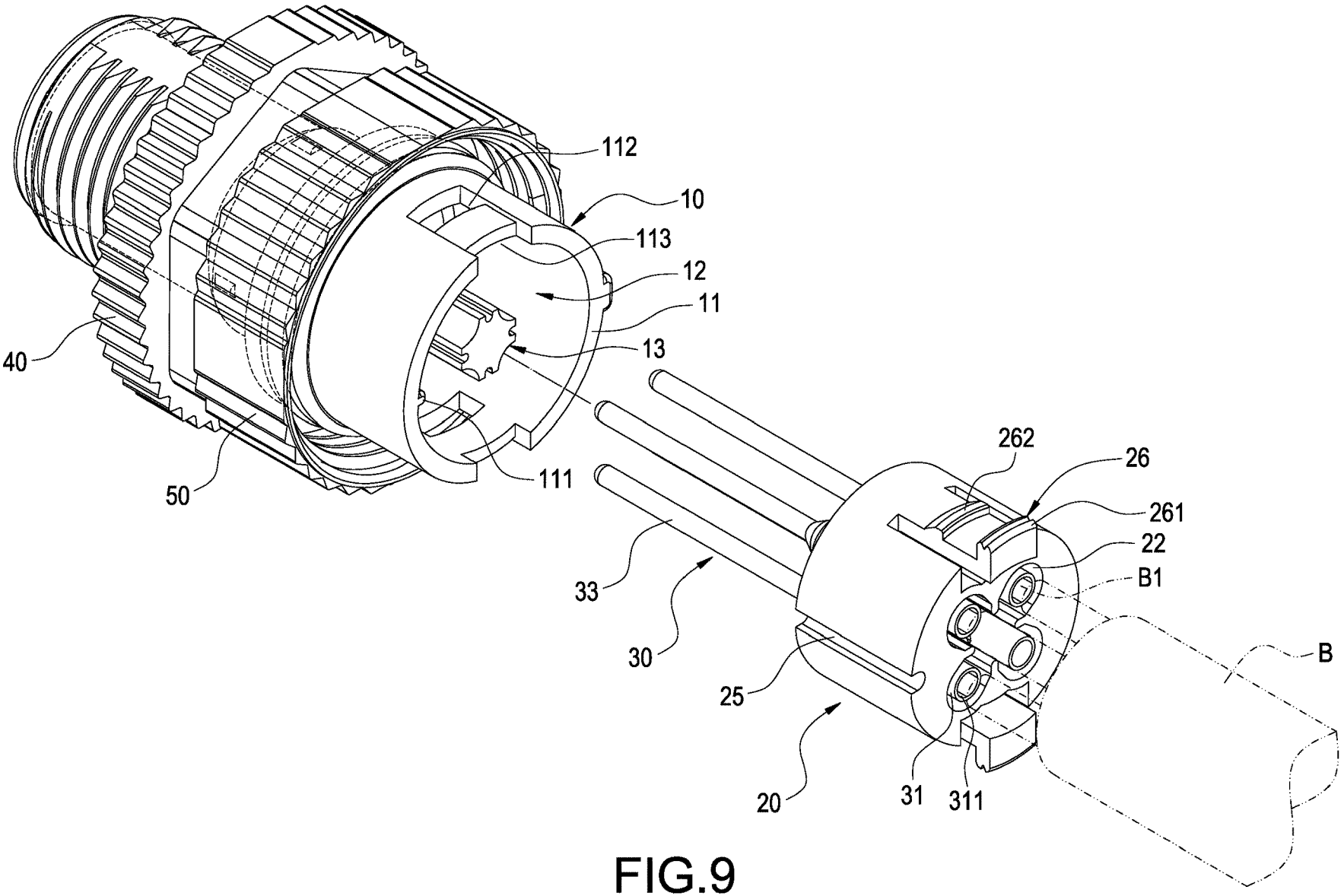
FIG. 9 is another exploded view of the invention.

Please refer to FIG. 9. In addition to the above embodiment, the easily assembled connector of the invention may also be assembled by inserting the conductive terminals 30 correspondingly into the troughs 22 of the plastic core 20 first and then putting both the plastic core 20 and the conductive terminals 30 on the guiding pillar 13 through the guiding hole 21 to make slidable connection to accomplish rapid assembling of the plastic core 20, the conductive terminals 30 and the insulative base 10.

Figure 10:
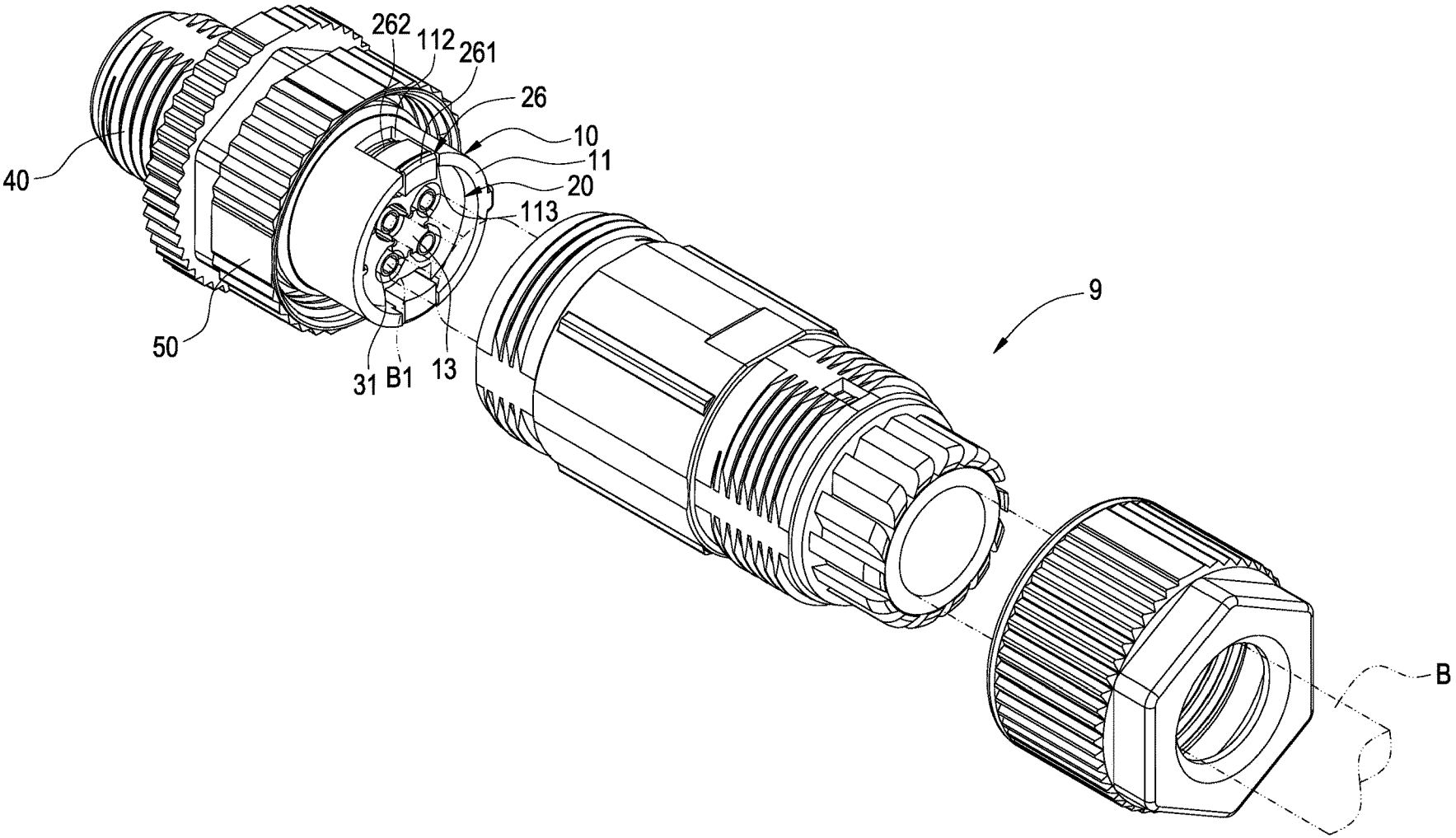
FIG. 10 is an exploded view of the easily assembled connector of the invention and a corresponding connector.
Figure 11:
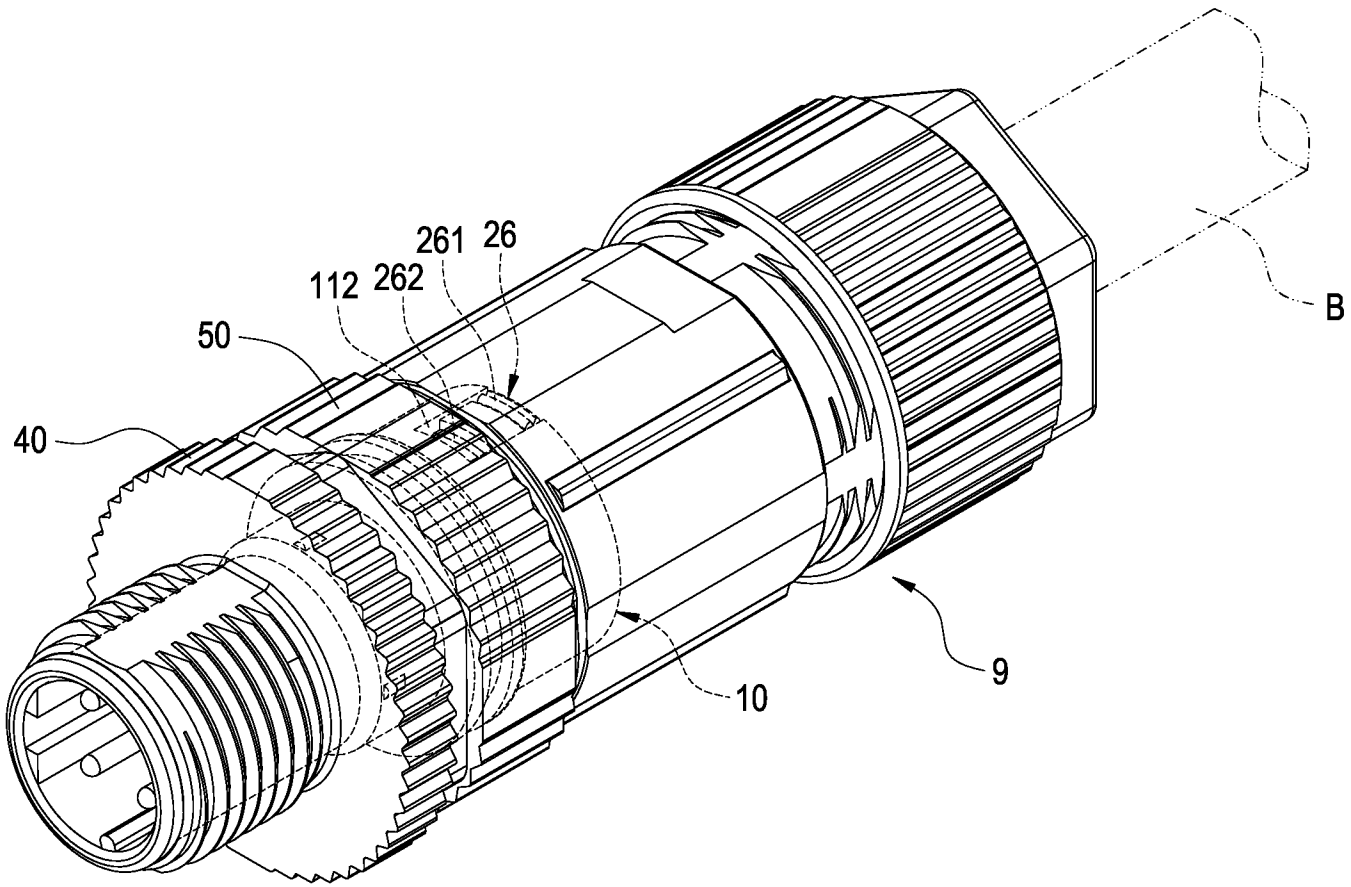
FIG. 11 is an assembled view of the easily assembled connector of the invention and a corresponding connector.
Figure 12:
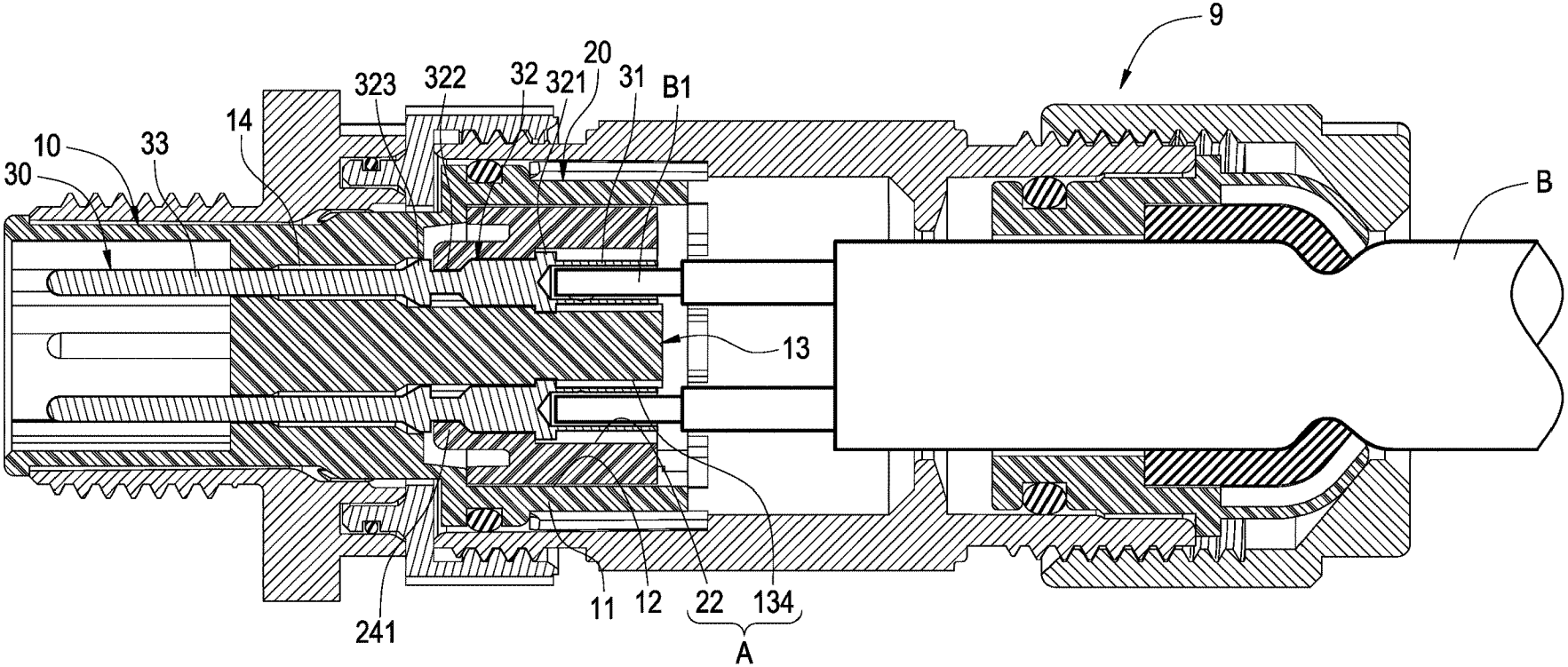
FIG. 12 is an assembled cross-section view of the easily assembled connector of the invention and a corresponding connector.

Please refer to FIGS. 10-12. The easily assembled connector of the invention may be associated with a wire B and a connecting member 9 to constitute a connector assembly. The connecting member 9 is put around the wire B first, then connect each of the core wires B1 of the wire B to one of the connecting sections 31 of the conductive terminals 30, next insert the assembled conductive terminals 30 and core wires B1 into the troughs 22 one by one, and finally put both the plastic core 20 and the conductive terminals 30 into the chamber 12 of the insulative base 10. The assembling is accomplished by the slidable fit of the guiding pillar 13 and the guiding hole 21 and the positioning of the engaging block 262 of the flexible arm 26 and the engaging hole 112. When disassembling, press the handle stem 261 to make the engaging block 262 escape from the engaging hole 112 and make the elastic hook 241 aslant bent outward by pulling to easily take both the plastic core 20 and the conductive terminals 30 out of the insulative base 10. Also, all components can be used repeatedly.

It will be appreciated by persons skilled in the art that the above embodiments have been described by way of example only and not in any limitative sense, and that various alterations and modifications are possible without departure from the scope of the invention as defined by the appended claims.

What is claimed is:

1. A connector comprising:

an insulative base (10) having a chamber (12);

a plastic core (20), correspondingly received in the chamber (12), having a guiding hole (21) and troughs (22) surrounding and communicating with the guiding hole (21), and each trough (22) being formed with a terminal hole (A); and conductive terminals (30) separately correspondingly installed in each terminal hole (A), wherein a center of the chamber (12) is extended with a guiding pillar (13), the guiding hole (21) is inserted by the guiding pillar (13), and the terminal hole (A) is formed by one of the troughs (22) and the guiding pillar (13);

wherein a side of the insulative base (10) is formed with an annular wall (11), the chamber (12) is formed in the annular wall (11), a positioning rib (111) is formed on an inner side of the annular wall (11), and an outer surface of the plastic core (20) is formed with a positioning channel (25) for being embedded by the positioning rib (111);

wherein two corresponding positions of the annular wall (11) are separately provided with an engaging hole (112) and an engaging notch (113), each of two corresponding positions of the plastic core (20) is provided with a flexible arm (26), each flexible arm (26) is formed with a handle stem (261) being embedded into the engaging notch (113) for engagement, and an engaging block (262) is embedded into the engaging hole (112) for engagement.

2. The connector of claim 1, wherein the guiding pillar (13) comprises a vertical rod (131) and a horizontal rod (132) across the vertical rod (131), a concave curved surface (134) is formed between every two adjacent end surfaces of the vertical rod (131) and the horizontal rod (132), and each terminal hole (A) is formed by one of the concave curved surfaces (134) and one of the troughs (22).

3. The connector of claim 2, wherein each end surface of both the vertical rod (131) and the horizontal rod (132) is formed with a groove (133), a protrusion bar (23) is formed between every two adjacent troughs (22), and each protrusion bar (23) is embedded into one of the grooves (133).

4. The connector of claim 2, wherein a through hole (14) penetrating the insulative base (10) is provided at a root of each concave curved surface (134), each conductive terminal (30) comprises a guiding section (33) penetrating through and projecting from the through hole (14).

5. The connector of claim 1, wherein each conductive terminal (30) comprises a connecting section (31), a fixing section (32) extending from the connecting section (31) and a guiding section (33) extending from the fixing section (32), each fixing section (32) has a stopping ring (321), a blocking ring (24) is provided in each of the troughs (22), and the stopping ring (321) is stopped by the blocking ring (24).

6. The connector of claim 5, wherein the fixing section (32) has a neck portion (322) below the stopping ring (321), a bottom end of the blocking ring (24) is formed with an elastic hook (241), an escaping space (242) is formed between a back of the elastic hook (241) and an inner wall of the chamber (12), and the elastic hook (241) is embedded into and engage with the neck portion (322).

7. The connector of claim 5, wherein the connecting section (31) has a wire hole (311) for being inserted by a core wire (B1) of a wire (B).

8. The connector of claim 1, further comprising a sleeve (40) around a side of the insulative base (10) and a screwing element (50) connected to an end of the sleeve (40) and put around the insulative base (10).

* * * * *